US011142883B2

(12) United States Patent
Izumikawa

(10) Patent No.: US 11,142,883 B2
(45) Date of Patent: Oct. 12, 2021

(54) SHOVEL

(71) Applicant: SUMITOMO (S.H.I) CONSTRUCTION MACHINERY CO., LTD., Tokyo (JP)

(72) Inventor: Takeya Izumikawa, Chiba (JP)

(73) Assignee: SUMITOMO (S.H.I.) CONSTRUCTION MACHINERY CO., LTD., Tokyo (JP)

( * ) Notice: Subject to any disclaimer, the term of this patent is extended or adjusted under 35 U.S.C. 154(b) by 311 days.

(21) Appl. No.: 16/363,163

(22) Filed: Mar. 25, 2019

(65) Prior Publication Data

US 2019/0218744 A1 Jul. 18, 2019

Related U.S. Application Data

(63) Continuation of application No. PCT/JP2017/035184, filed on Sep. 28, 2017.

(30) Foreign Application Priority Data

Sep. 30, 2016 (JP) ..... JP2016-195069

(51) Int. Cl.
*E02F 3/40* (2006.01)
*E02F 3/96* (2006.01)
(Continued)

(52) U.S. Cl.
CPC ..... *E02F 3/40* (2013.01); *E02F 3/425* (2013.01); *E02F 3/435* (2013.01); *E02F 3/962* (2013.01);
(Continued)

(58) Field of Classification Search
CPC ..... E02F 9/2029; E02F 9/226; E02F 9/2285; E02F 9/20; E02F 9/2004; E02F 9/2075;
(Continued)

(56) References Cited

U.S. PATENT DOCUMENTS 4,633,383 A 12/1986 Omachi et al.
8,620,533 B2 * 12/2013 Taylor ..... E02F 3/435 701/50

(Continued)

FOREIGN PATENT DOCUMENTS

GB 2306705 5/1997
JP S55-118062 U 8/1980

(Continued)

OTHER PUBLICATIONS

International Search Report for PCT/JP2017/035184 dated Nov. 21, 2017.

*Primary Examiner* — Jessica H Lutz
(74) *Attorney, Agent, or Firm* — IPUSA, PLLC

(57) ABSTRACT

A shovel having a machine guidance function or a machine control function includes a lower traveling body, an upper turning body turnably mounted on the lower traveling body, a cab mounted on the upper turning body, an attachment attached to the upper turning body, a display device provided in the cab, and a control device configured to guide or automatically assist an operation of the shovel according to a target value that is preset. The control device is configured to display geometric information on the display device using information on two end positions of the attachment at two points of time, and to set the target value based on the information on the two end positions.

11 Claims, 10 Drawing Sheets

(51) Int. Cl.
*E02F 9/20* (2006.01)
*E02F 9/26* (2006.01)
*E02F 3/43* (2006.01)
*E02F 3/42* (2006.01)

(52) U.S. Cl.
CPC ..... *E02F 9/20* (2013.01); *E02F 9/2004* (2013.01); *E02F 9/26* (2013.01)

(58) Field of Classification Search
CPC ..... E02F 9/2246; E02F 9/2253; E02F 9/262; E02F 9/264; E02F 9/265; E02F 3/40; E02F 3/435; E02F 3/425; E02F 3/32
See application file for complete search history.

(56) References Cited

U.S. PATENT DOCUMENTS

| | | | | |
|---|---|---|---|---|
| 9,540,786 | B2 | 1/2017 | Ogawa | |
| 9,617,709 | B2 * | 4/2017 | Shintani | E02F 9/2004 |
| 10,161,111 | B2 * | 12/2018 | Iwanaga | G01S 19/43 |
| 2007/0010925 | A1 * | 1/2007 | Yokoyama | E02F 9/261 701/50 |
| 2008/0047170 | A1 * | 2/2008 | Nichols | G01S 19/45 37/348 |
| 2012/0232763 | A1 * | 9/2012 | Mizuochi | B66C 23/905 701/50 |
| 2013/0066527 | A1 * | 3/2013 | Mizuochi | B66C 23/905 701/50 |
| 2014/0343800 | A1 * | 11/2014 | Nelson | E02F 3/845 701/49 |
| 2015/0368876 | A1 * | 12/2015 | Nakagaki | E02F 3/435 701/50 |
| 2016/0145827 | A1 | 5/2016 | Kami et al. | |
| 2016/0193920 | A1 * | 7/2016 | Tsubone | E02F 9/16 701/36 |
| 2017/0175364 | A1 * | 6/2017 | Hasegawa | E02F 9/261 |
| 2018/0230671 | A1 * | 8/2018 | Wu | E02F 3/32 |
| 2018/0251961 | A1 * | 9/2018 | France | E02F 3/32 |
| 2018/0313063 | A1 * | 11/2018 | Elkins | E02F 3/435 |
| 2019/0017248 | A1 * | 1/2019 | Okada | G01M 1/122 |
| 2019/0024344 | A1 * | 1/2019 | Okui | E02F 9/26 |
| 2019/0078302 | A1 * | 3/2019 | Yamada | E02F 3/43 |
| 2019/0211532 | A1 * | 7/2019 | Sakamoto | E02F 3/425 |
| 2019/0218744 | A1 * | 7/2019 | Izumikawa | E02F 3/40 |
| 2019/0241124 | A1 * | 8/2019 | Izumikawa | B60R 11/04 |
| 2019/0249391 | A1 * | 8/2019 | Kikuchi | E02F 9/26 |
| 2019/0359145 | A1 * | 11/2019 | Sakuta | E02F 9/261 |
| 2020/0071909 | A1 * | 3/2020 | Harada | E02F 9/2041 |
| 2021/0002862 | A1 * | 1/2021 | Ono | G07C 5/0816 |

FOREIGN PATENT DOCUMENTS

| | | |
|---|---|---|
| JP | S61-064933 | 4/1986 |
| JP | S62-185932 | 8/1987 |
| JP | H04-044046 | 2/1992 |
| JP | H06-200537 | 7/1994 |
| JP | H08-158408 | 6/1996 |
| JP | 4311577 | 8/2009 |
| JP | 2014-177784 | 9/2014 |
| JP | 2014-224452 | 12/2014 |
| JP | 2016-079677 | 5/2016 |
| JP | 2016-084663 | 5/2016 |
| KR | 10-2016-0001869 | 1/2016 |
| WO | 2005/024144 | 3/2005 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2017/035184, filed on Sep. 28, 2017 and designating the U.S., which claims priority to Japanese patent application No. 2016-195069, filed on Sep. 30, 2016. The entire contents of the foregoing applications are incorporated herein by reference.

BACKGROUND

Technical Field

The present invention relates to shovels.

Description of Related Art

Conventionally, a device that monitors the working condition of a power shovel is known. This device displays the motion trajectory of the blade edge of a bucket and a target excavation line on a monitor placed in a cabin to enable an operator to properly perform slope excavation work.

SUMMARY

According to an aspect of the present invention, a shovel having a machine guidance function or a machine control function includes a lower traveling body, an upper turning body turnably mounted on the lower traveling body, a cab mounted on the upper turning body, an attachment attached to the upper turning body, a display device provided in the cab, and a control device configured to guide or automatically assist an operation of the shovel according to a target value that is preset. The control device is configured to display geometric information on the display device using information on two end positions of the attachment at two points of time, and to set the target value based on the information on the two end positions.

DETAILED DESCRIPTION

As noted above, the conventional device that monitors the working condition of a power shovel displays the motion trajectory of the blade edge of a bucket and a target excavation line on a monitor placed in a cabin to enable an operator to properly perform slope excavation work.

It is necessary for the operator, however, to perform the troublesome work of manually inputting a target value for a slope angle or the like in order to display the target excavation line.

According to an aspect of the present invention, it is possible to provide a shovel in which a target value used by a machine guidance function or a machine control function can be set more easily.

Figure 1:
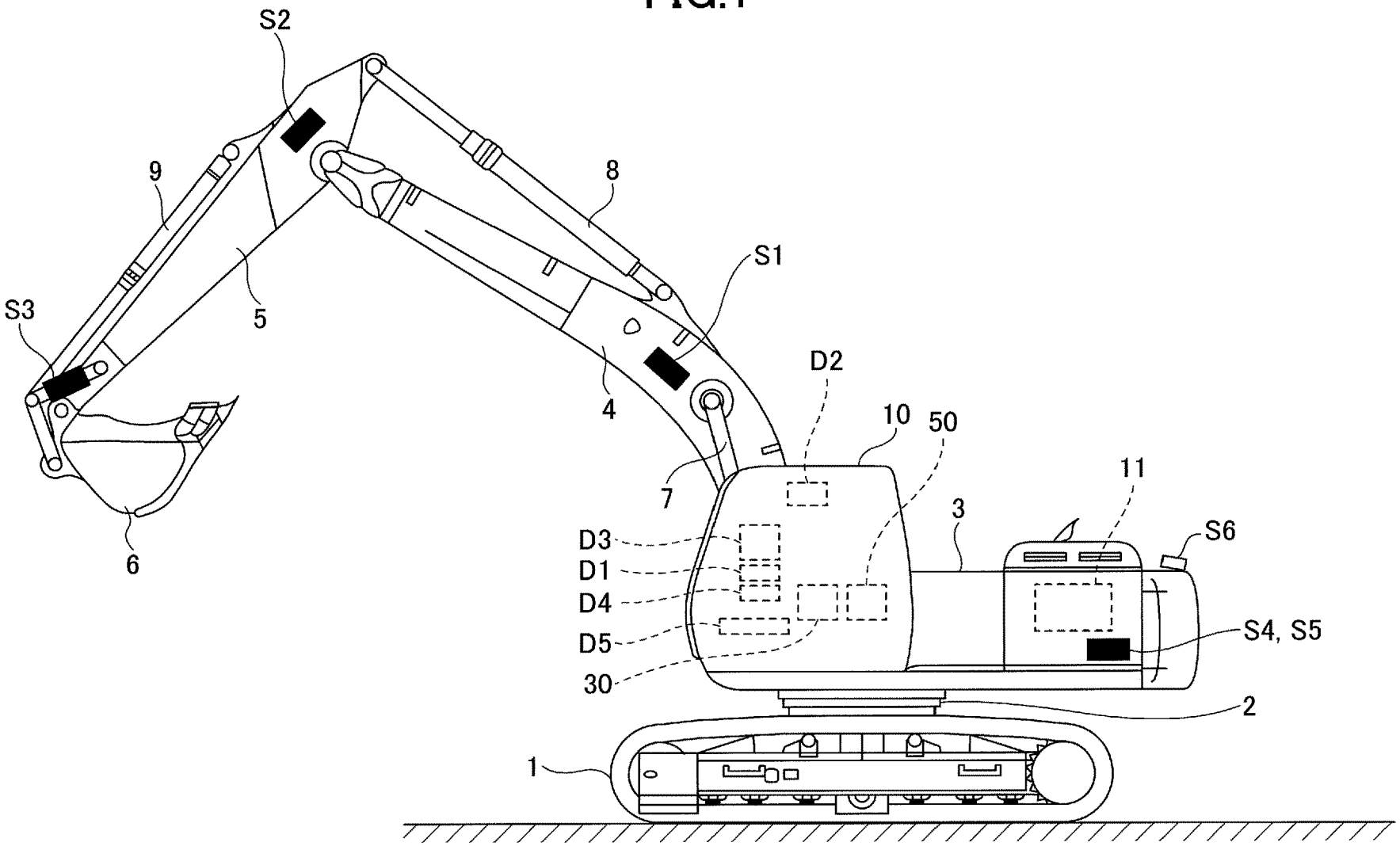
FIG. 1 is a side view of a shovel according to an embodiment of the present invention.

FIG. 1 is a side view of a shovel (an excavator) according to an embodiment of the present invention. An upper turning body 3 is turnably mounted on a lower traveling body 1 of the shovel via a turning mechanism 2. A boom 4 is attached to the upper turning body 3. An arm 5 is attached to the end of the boom 4. A bucket 6 serving as an end attachment is attached to the end of the arm 5. A slope bucket, a dredging bucket or the like may alternatively be used as an end attachment.

The boom 4, the arm 5, and the bucket 6 form an excavation attachment as an example of an attachment, and are hydraulically driven by a boom cylinder 7, an arm cylinder 8, and a bucket cylinder 9, respectively. A boom angle sensor S1 is attached to the boom 4. An arm angle sensor S2 is attached to the arm 5. A bucket angle sensor S3 is attached to the bucket 6. A bucket tilt mechanism may be provided on the excavation attachment.

The boom angle sensor S1 detects the rotation angle of the boom 4. According to this embodiment, the boom angle sensor S1 is an acceleration sensor that detects the rotation angle of the boom 4 relative to the upper turning body 3 by detecting an inclination to a horizontal plane.

The arm angle sensor S2 detects the rotation angle of the arm 5. According to this embodiment, the arm angle sensor S2 is an acceleration sensor that detects the rotation angle of the arm 5 relative to the boom 4 by detecting an inclination to a horizontal plane.

The bucket angle sensor S3 detects the rotation angle of the bucket 6. According to this embodiment, the bucket angle sensor S3 is an acceleration sensor that detects the rotation angle of the bucket 6 relative to the arm 5 by detecting an inclination to a horizontal plane. When the excavation attachment is provided with a bucket tilt mechanism, the bucket angle sensor S3 additionally detects the rotation angle of the bucket 6 about a tilt axis.

The boom angle sensor S1, the arm angle sensor S2, and the bucket angle sensor S3 may be a combination of an acceleration sensor and a gyro sensor, or may be potentiometers using a variable resistor, stroke sensors that detect the stroke amount of a corresponding hydraulic cylinder, or rotary encoders that detect a rotation angle about a connecting pin. The boom angle sensor S1, the arm angle sensor S2, and the bucket angle sensor S3 form a posture sensor that detects information on the posture of the excavation attachment. The posture sensor may detect information on the posture of the excavation attachment by combining the output of a gyro sensor.

A cabin 10 serving as a cab is provided and power sources such as an engine 11 are mounted on the upper turning body 3. Furthermore, a body tilt sensor S4, a turning angular velocity sensor S5, and a camera S6 are attached to the upper turning body 3.

The body tilt sensor S4 detects the inclination of the upper turning body 3 relative to a horizontal plane. According to this embodiment, the body tilt sensor S4 is a two-axis acceleration sensor that detects the tilt angle of the upper turning body 3 around its longitudinal axis and lateral axis. The body tilt sensor S4 may be a three-axis acceleration sensor. For example, the longitudinal axis and the lateral axis of the upper turning body 3 are perpendicular to each other and pass the center point of the shovel that is a point on the turning axis of the shovel.

The turning angular velocity sensor S5 is, for example, a gyro sensor, and detects the turning angular velocity of the upper turning body 3. The turning angular velocity sensor S5 may alternatively be a resolver, a rotary encoder, or the like.

The camera S6 is a device that obtains an image of the surroundings of the shovel. According to this embodiment, the camera S6 is one or more cameras attached to the upper turning body 3.

An input device D1, an audio output device D2, a display device D3, a storage device D4, a gate lock lever D5, a controller 30, and a machine guidance device 50 are installed in the cabin 10.

The controller 30 operates as a main control part that controls the driving of the shovel. According to this embodiment, the controller 30 is composed of a processing unit including a CPU and an internal memory. The CPU executes a program stored in the internal memory to implement various functions of the controller 30.

The machine guidance device 50 executes a machine guidance function and guides operations of the shovel. According to this embodiment, for example, the machine guidance device 50 visually and aurally notifies an operator of a vertical distance between a target work surface set by the operator and the end position of the bucket 6. The end position of the bucket 6 is, for example, a tooth tip position. The machine guidance device 50 thus guides operations of the shovel by the operator. The machine guidance device 50 may only visually or only aurally notify the operator of the distance. Specifically, like the controller 30, the machine guidance device 50 is composed of a processing unit including a CPU and an internal memory. The CPU executes a program stored in the internal memory to implement various functions of the machine guidance device 50. The machine guidance device 50 may be incorporated in the controller 30.

The machine guidance device 50 may execute a machine control function to automatically assist operations of the shovel by the operator. For example, during an excavating operation by the operator, the machine guidance device 50 assists the motions of the boom, 4, the arm 5, and the bucket 6 such that the target work surface coincides with the end position of the bucket 6. For example, during an arm closing operation by the operator, the machine guidance device 50 automatically extends or retracts at least one of the boom cylinder 7 and the bucket cylinder 9 to make the target work surface coincide with the end position of the bucket 6. In this case, only by operating a single operating lever, the operator can perform excavation work while making the target work surface coincide with the end position of the bucket 6 by simultaneously moving the boom 4, the arm 5, and the bucket 6.

The input device D1 is a device for inputting various kinds of information to the machine guidance device 50 by the operator of the shovel. According to this embodiment, the input device D1 is a membrane switch attached to the periphery of the display device D3. A touchscreen may be used as the input device D1.

The audio output device D2 outputs various kinds of audio information in response to an audio output command from the machine guidance device 50. According to this embodiment, an in-vehicle speaker directly connected to the machine guidance device 50 is used as the audio output device D2. An alarm such as a buzzer may be used as the audio output device D2.

The display device D3 displays various kinds of image information in response to a command from the machine guidance device 50. According to this embodiment, an in-vehicle liquid crystal display directly connected to the machine guidance device 50 is used as the display device D3. An image captured by the camera S6 may be displayed on the display device D3.

The storage device D4 stores various kinds of information. According to this embodiment, a non-volatile storage medium such as a semiconductor memory is used as the storage device D4. The storage device D4 stores various kinds of information output by the machine guidance device 50, etc., such as design data.

The gate lock lever D5 is a mechanism that prevents the shovel from being accidentally operated. According to this embodiment, the gate lock lever D5 is provided between the door and the operator's seat of the cabin 10. When the gate lock lever D5 is pulled up to prevent the operator from getting out of the cabin 10, various operating apparatuses become operable. When the gate lock lever D5 is pushed down to let the operator get out of the cabin 10, various operating apparatuses become inoperable.

Figure 2:
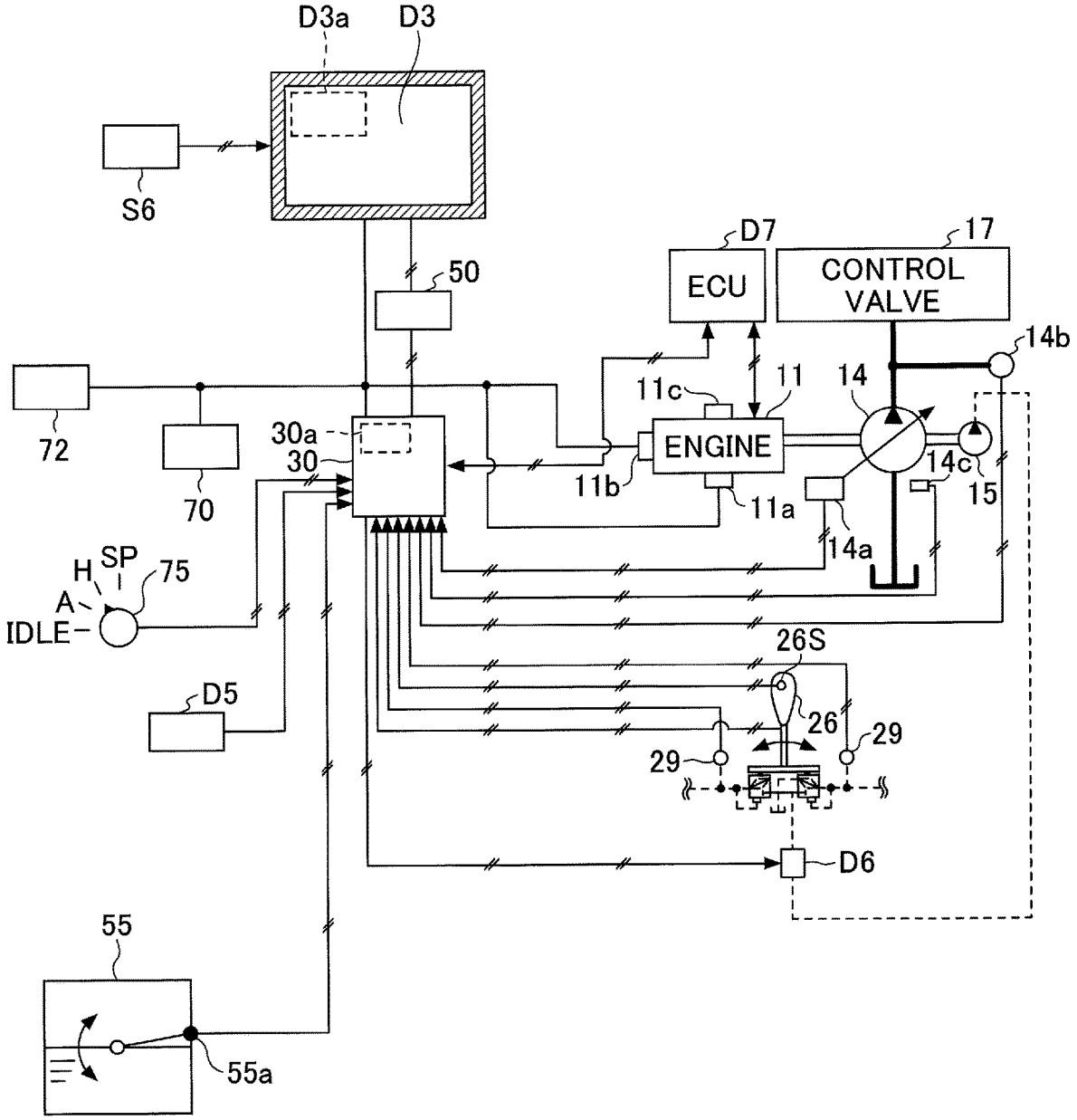
FIG. 2 is a diagram illustrating a configuration of a drive control system of the shovel of FIG. 1.

FIG. 2 is a diagram illustrating a configuration of the drive control system of the shovel of FIG. 1. In FIG. 2, a mechanical power transmission system, a hydraulic oil line, a pilot line, and an electric control system are indicated by a double line, a thick solid line, a dashed line, and a thin solid line, respectively.

The engine 11 is a drive source of the shovel. According to this embodiment, the engine 11 is a diesel engine that adopts isochronous control to maintain a constant engine rotational speed irrespective of an increase or decrease in an engine load. The amount of fuel injection, the timing of fuel injection, boost pressure, etc., in the engine 11 are controlled by an engine controller unit (ECU) D7.

A main pump 14 and a pilot pump 15 serving as hydraulic pumps have respective rotating shafts connected to the rotating shaft of the engine 11. A control valve 17 is connected to the main pump 14 via a hydraulic line.

The control valve 17 is a hydraulic control device that controls the hydraulic system of the shovel. Hydraulic actuators such as left and right traveling hydraulic motors, the boom cylinder 7, the arm cylinder 8, the bucket cylinder 9, and a turning hydraulic motor are connected to the control valve 17 through hydraulic lines.

An operating apparatus 26 is connected to the pilot pump 15 via a pilot line and a gate lock valve D6. The operating apparatus 26 includes operating levers and operating pedals. Furthermore, the operating apparatus 26 is connected to the control valve 17 via a pilot line.

A knob switch serving as a switch 26S is provided at the end of an operating lever serving as the operating apparatus 26. The operator can operate the knob switch with fingers without releasing her/his hand from the operating lever. The switch 26S may alternatively be a pedal switch. The operator can operate the pedal switch with her/his foot without releasing her/his hand from the operating lever.

The gate lock valve D6 switches communication and interruption of a pilot line connecting the pilot pump 15 and the operating apparatus 26. According to this embodiment, the gate lock valve D6 is a solenoid valve that switches communication and interruption of the pilot line in response to a command from the controller 30. The controller 30 determines the state of the gate lock lever D5 based on a state signal output by the gate lock lever D5. In response to determining that the gate lock lever D5 is pulled up, the controller 30 outputs a signal for communication to the gate lock valve D6. In response to receiving the signal for communication, the gate lock valve D6 opens to open the pilot line. As a result, the operating apparatus 26 is enabled for the operator's operations. In response to determining that that the gate lock lever D5 is pulled down, the controller 30 outputs a signal for interruption to the gate lock valve D6. In response to receiving the signal for interruption, the gate lock valve D6 closes to interrupt the pilot line. As a result, the operating apparatus 26 is disabled for the operator's operations.

Pressure sensors 29 detect the contents of an operation of the operating apparatus 26 in the form of pressure. The pressure sensors 29 output detection values to the controller 30.

Furthermore, FIG. 2 illustrates a connection relationship between the controller 30 and the display device D3. According to this embodiment, the display device D3 is connected to the controller 30 via the machine guidance device 50. The display device D3, the machine guidance device 50, and the controller 30 may be connected via a communications network such as CAN.

The display device D3 includes a conversion part D3*a* that generates an image. According to this embodiment, the conversion part D3*a* generates a camera image to be displayed based on the output of the camera S6, for example. The camera S6 is connected to the display device D3 via a dedicated line, for example.

The conversion part D3*a* may also generate an image to be displayed based on the output of the controller 30 or the machine guidance device 50. According to this embodiment, the conversion part D3*a* converts various kinds of information output by the controller 30 or the machine guidance device 50 into an image signal. Examples of the output Information of the controller 30 include data indicating the temperature of engine coolant water, data indicating the temperature of hydraulic oil, data indicating the remaining amount of fuel, and data indicating the remaining amount of an aqueous urea solution. Examples of the output information of the machine guidance device 50 include data indicating the end position of the bucket 6 and data on a target work surface.

The conversion part D3*a* may be implemented not as a function of the display device D3 but as a function of the controller 30 or the machine guidance device 50. In this case, the camera S6 is connected to not the display device D3 but the controller 30 or the machine guidance device 50.

The display device D3 is supplied with electric power from a rechargeable battery 70 to operate. The rechargeable battery 70 is charged with electric power generated in an alternator 11*a* (generator). The electric power of the rechargeable battery 70 is also supplied to electrical equipment 72, etc., of the shovel besides the controller 30 and the display device D3. A starter 11*b* is driven with electric power from the rechargeable battery 70 to start the engine 11.

The engine 11 is controlled by the engine controller unit D7. The engine controller unit D7 transmits various kinds of data indicating the condition of the engine 11 to the controller 30. The various kinds of data indicating the condition of the engine 11 are an example of the operating information of the shovel, and include, for example, data indicating a coolant water temperature detected at a water temperature sensor 11*c* serving as an operating information obtaining part. The controller 30 may store these data in a temporary storage part (memory) 30*a* and transmit the data to the display device D3 when necessary.

Furthermore, the controller 30 is fed with various kinds of data as operating information of the shovel as follows. The various kinds of data are stored in the temporary storage part 30*a* of the controller 30.

For example, a regulator 14*a* of the main pump 14, which is a variable displacement hydraulic pump, feeds the controller 30 with data indicating a swash plate tilt angle. Furthermore, a discharge pressure sensor 14*b* feeds the controller 30 with data indicating the discharge pressure of the main pump 14. These data are stored in the temporary storage part 30*a*. An oil temperature sensor 14*c* is provided in a conduit between the main pump 14 and a tank storing hydraulic oil that the main pump 14 draws in. The oil temperature sensor 14*c* feeds the controller 30 with data representing the temperature of hydraulic oil flowing through the conduit. The regulator 14*a*, the discharge pressure sensor 14*b*, and the oil temperature sensor 14*c* are specific examples of the operating information obtaining part.

A contained fuel amount detecting part 55*a* in a fuel containing part 55 feeds the controller 30 with data indicating the amount of contained fuel. According to this embodiment, a remaining fuel amount sensor serving as the contained fuel amount detecting part 55*a* in a fuel tank serving as the fuel containing part 55 feeds the controller 30 with data indicating the status of the amount of remaining fuel.

Specifically, the remaining fuel amount sensor is composed of a float that follows a liquid surface and a variable resistor (potentiometer) that converts a vertical variation of the float into a resistance value. This configuration makes it possible for the remaining fuel amount sensor to have the status of the amount of remaining fuel steplessly displayed on the display device D3. The contained fuel amount detecting part 55*a* may suitably select a detection method in accordance with a usage environment, etc. A detection method that can display the amount of remaining fuel in a stepwise manner may be adopted. These configurations are the same for an aqueous urea solution tank.

When the operating apparatus 26 is operated, the pressure sensors 29 detect a pilot pressure that acts on the control valve 17. The pressure sensors 29 feed the controller 30 with data indicating the detected pilot pressure.

According to this embodiment, the shovel has an engine rotational speed adjustment dial 75 provided in the cabin 10. The engine rotational speed adjustment dial 75 is a dial for adjusting the rotational speed of the engine 11, and makes it possible to switch the engine rotation speed among four levels. The engine rotational speed adjustment dial 75 transmits data indicating the setting of the engine rotational speed to the controller 30. The engine rotational speed adjustment dial 75 can switch the engine rotational speed among the four levels of SP mode, H mode, A mode, and idling mode. FIG. 2 illustrates a state where the H mode is selected by the engine rotational speed adjustment dial 75.

The SP mode is a rotational speed mode selected by the operator when the operator desires to prioritize workload, and uses the highest engine rotational speed. The H mode is a rotational speed mode selected by the operator when the operator desires to satisfy both workload and fuel efficiency, and uses the second highest engine rotational speed. The A mode is a rotational speed mode selected by the operator when the operator desires to operate the shovel with low noise while prioritizing fuel efficiency, and uses the third highest engine rotational speed. The idling mode is a rotational speed mode selected by the operator when the operator desires to idle the engine 11, and uses the lowest engine rotational speed. The engine 11 is controlled to a constant rotational speed at the engine rotational speed of the rotational speed mode set by the engine rotational speed adjustment dial 75.

Figure 3:
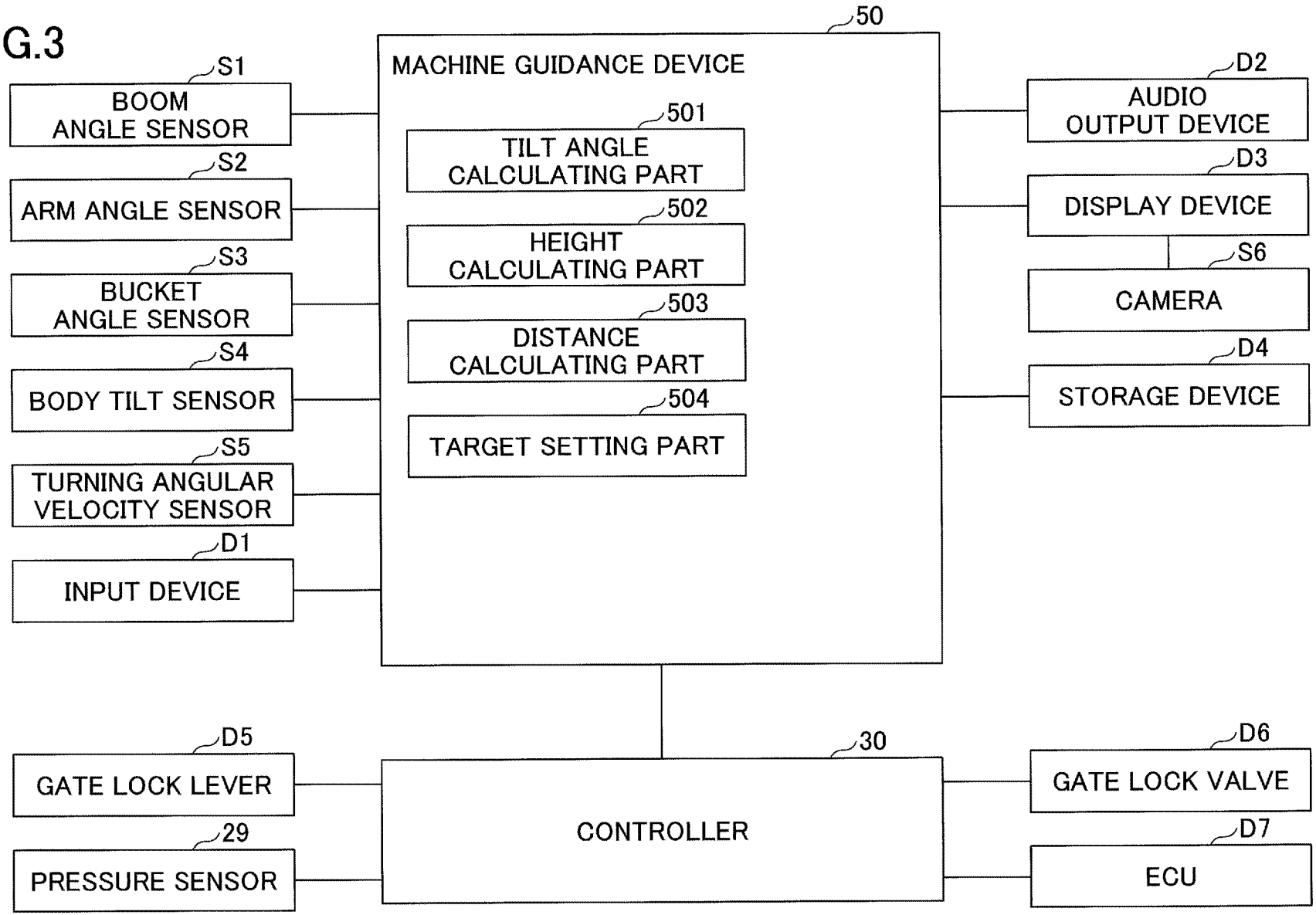
FIG. 3 is a block diagram illustrating a configuration of a machine guidance device.

Next, various functional elements of the machine guidance device 50 are described with reference to FIG. 3. FIG. 3 is a block diagram illustrating a configuration of the machine guidance device 50.

The machine guidance device 50 receives the output information of the boom angle sensor S1, the arm angle sensor S2, the bucket angle sensor S3, the body tilt sensor S4, the turning angular velocity sensor S5, the input device D1, the controller 30, etc. The machine guidance device 50 executes various operations based on the received information and information stored in the storage device D4, and outputs the operation results to the audio output device D2, the display device D3, etc.

For example, the machine guidance device 50 calculates the height of the working part of the attachment, and outputs a control command corresponding to the size of the distance between the height of the working part and a predetermined target height to at least one of the audio output device D2 and the display device D3. In response to receiving the control command, the audio output device D2 outputs audio that represents the size of the distance. In response to receiving the control command, the display device D3 displays an image that represents the size of the distance. The target height is a concept including a target depth, and is a height that the operator inputs as a vertical distance relative to a reference position after causing the working part to contact the reference position, for example. The reference position typically has a known latitude, longitude, and altitude. Hereinafter, information on the size of the distance between the height of the working part of the attachment and the target height displayed on the display device D3 is referred to as "working part guidance information." The operator can proceed with work while checking the transition of the size of the distance by looking at the working part guidance information.

To perform the above-described guidance, the machine guidance device 50 includes a tilt angle calculating part 501, a height calculating part 502, a distance calculating part 503, and a target setting part 504.

The tilt angle calculating part 501 calculates the tile angle of the shovel, which is the tilt angle of the upper turning body 3 relative to a horizontal plane, based on a detection signal from the body tilt sensor S4.

The height calculating part 502 calculates the height of the working part of the attachment relative to a reference plane based on the tilt angle calculated by the tilt angle calculating part 501 and the respective rotation angles of the boom 4, the arm 5, and the bucket 6. The respective rotation angles of the boom 4, the arm 5, and the bucket 6 are calculated based on the respective detection signals of the boom angle sensor S1, the arm angle sensor S2, and the bucket angle sensor S3. The reference plane is, for example, a virtual plane including a plane in which the shovel is positioned. According to this embodiment, because excavation is performed with the end of the bucket 6, the end (tooth tip) of the bucket 6 corresponds to the working part of the attachment. In the case of performing work such as leveling earth and sand with the back surface of the bucket 6, the back surface of the bucket 6 corresponds to the working part of the attachment.

The distance calculating part 503 calculates the distance between the height of the working part calculated by the height calculating part 502 and a target height. According to this embodiment, the distance calculating part 503 calculates the distance between the height of the end (tooth tip) of the bucket 6 calculated by the height calculating part 502 and a target height.

The target setting part 504 sets a target value used by the machine guidance function or the machine control function. The target value is set, for example, in advance, namely, before executing the machine guidance function or the machine control function. The target setting part 504 sets the target value based on information on the positions of a predetermined portion of the excavation attachment at two points of time. For example, based on the position coordinates (coordinate points) of the end of the bucket 6 at two points of time, the target setting part 504 calculates the angle formed between a virtual straight line passing through these two coordinate points and a horizontal plane, and sets the angle as a target slope angle. Each of the two points of time is a point of time at which a predetermined condition is satisfied, examples of which include a point of time at which a predetermined switch is depressed and a point of time at which a predetermined time has passed with the excavation attachment remaining stationary. The target slope angle includes zero degrees.

The setting part 504 may display geometric information on the display device D3, using information on the positions of a predetermined portion of the excavation attachment at two points of time. The geometric information is, for example, information on the results of measurement by the shovel. For example, based on the position coordinates (coordinate points) of the end of the bucket 6 at two points of time, the setting part 504 displays the angle formed between a virtual straight line passing through these two coordinate points and a horizontal plane as geometric information on the display device D3. The two coordinate points may directly be displayed as geometric information, and the horizontal distance and the vertical distance between the two coordinate points may be displayed as geometric information. Here, of the two points of time, a first point of time is a point of time at which a predetermined condition is satisfied as described above, and a second point of time is a current point of time. Thus, the geometric information is displayed in order to have the operator recognize the positional relationship between the coordinate point of the predetermined portion recorded at the first point of time and the coordinate point of the predetermined portion at the current point of time.

Figure 4:
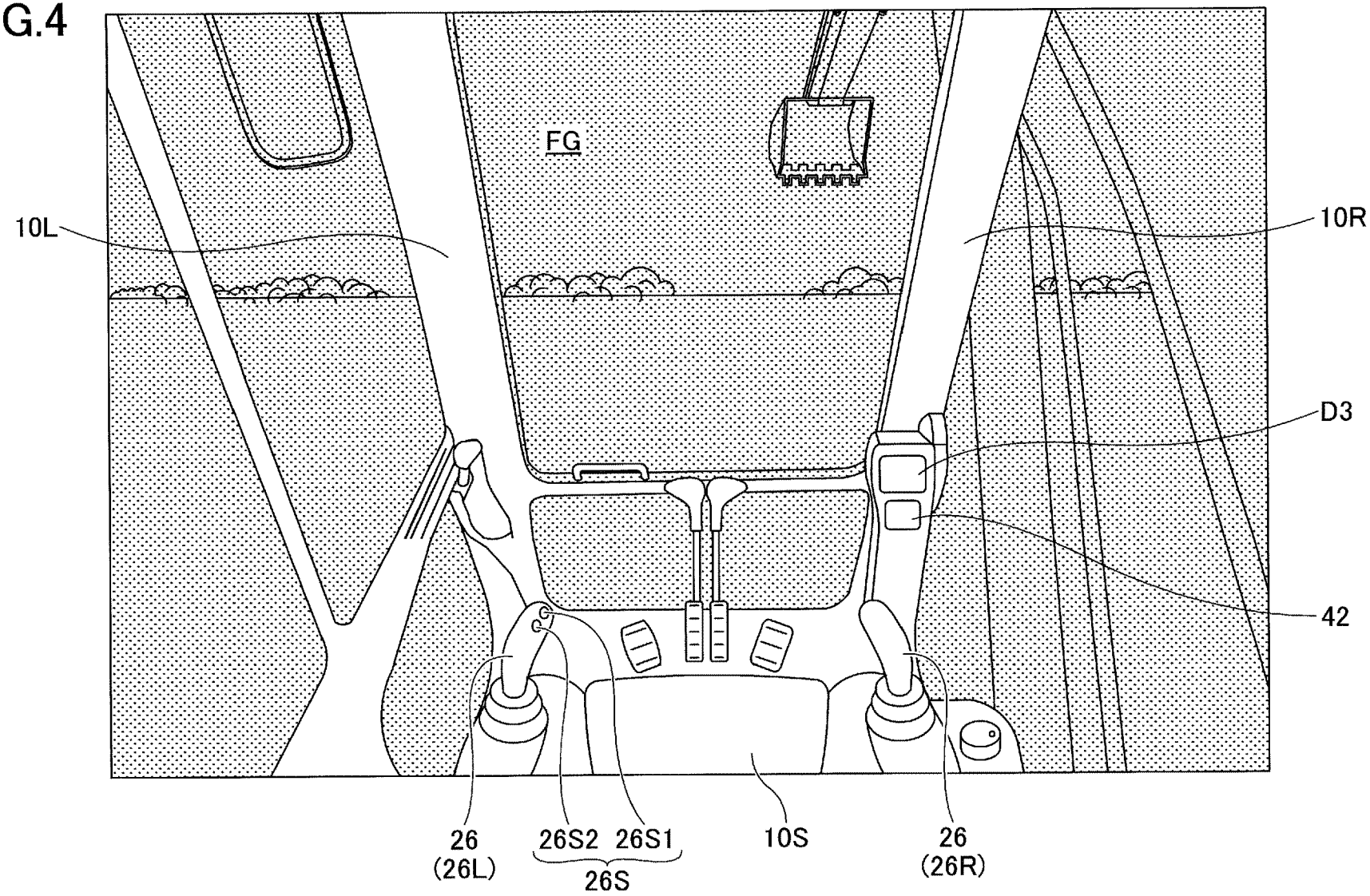
FIG. 4 is a perspective view of an inside of a cabin.

Next, attachment positions of various devices provided in the cabin 10 are described with reference to FIG. 4. FIG. 4 is a perspective view of the inside of the cabin 10, illustrating a forward looking view from an operator seat 10S of the shovel. In the illustration of FIG. 4, there are a left pillar 10L and a right pillar 10R, and the display device D3 is attached to the right pillar 10R in such a manner as to fit within the width of the right pillar 10R on the front right of the operator seat 10S, in order to enable the operator sitting on the operator seat 10S facing the front to look at the display device D3 during work, specifically, to enable the operator to see the display device D3 in her/his peripheral vision when having the bucket 6 in the center of her/his visual field through a windshield FG.

Operating levers serving as the operating apparatus 26 include a left operating lever 26L and a right operating lever 26R. A switch 26S is provided at the end of the left operating lever 26L. The operator can operate the switch 26S without releasing her/his hand from the operating lever. The switch 26S may alternatively be provided at the end of the right operating lever 26R or provided at the end of each of the left operating lever 26L and the right operating lever 26R.

In the illustration of FIG. 4, the switch 26S includes a reference setting button 26S1 and a measurement mode button 26S2. The reference setting button 26S1 is a button for setting a reference position. The measurement mode button 26S2 is a button for starting or ending a measurement mode.

The measurement mode is one of the operating modes of the shovel. The operating modes of the shovel include the measurement mode and a guidance mode.

The measurement mode is an operating mode that is selected when performing measurement using the shovel. According to this embodiment, the measurement mode starts when the measurement mode button 26S2 is depressed. The measurement mode is also selected when setting a target value used in the machine guidance function or the machine control function.

The guidance mode is an operating mode that is selected when executing the machine guidance function or the machine control function. According to this embodiment, the guidance mode starts when a guidance mode start button (not depicted) is depressed. The guidance mode is selected, for example, when forming a slope with the shovel.

Figure 5:
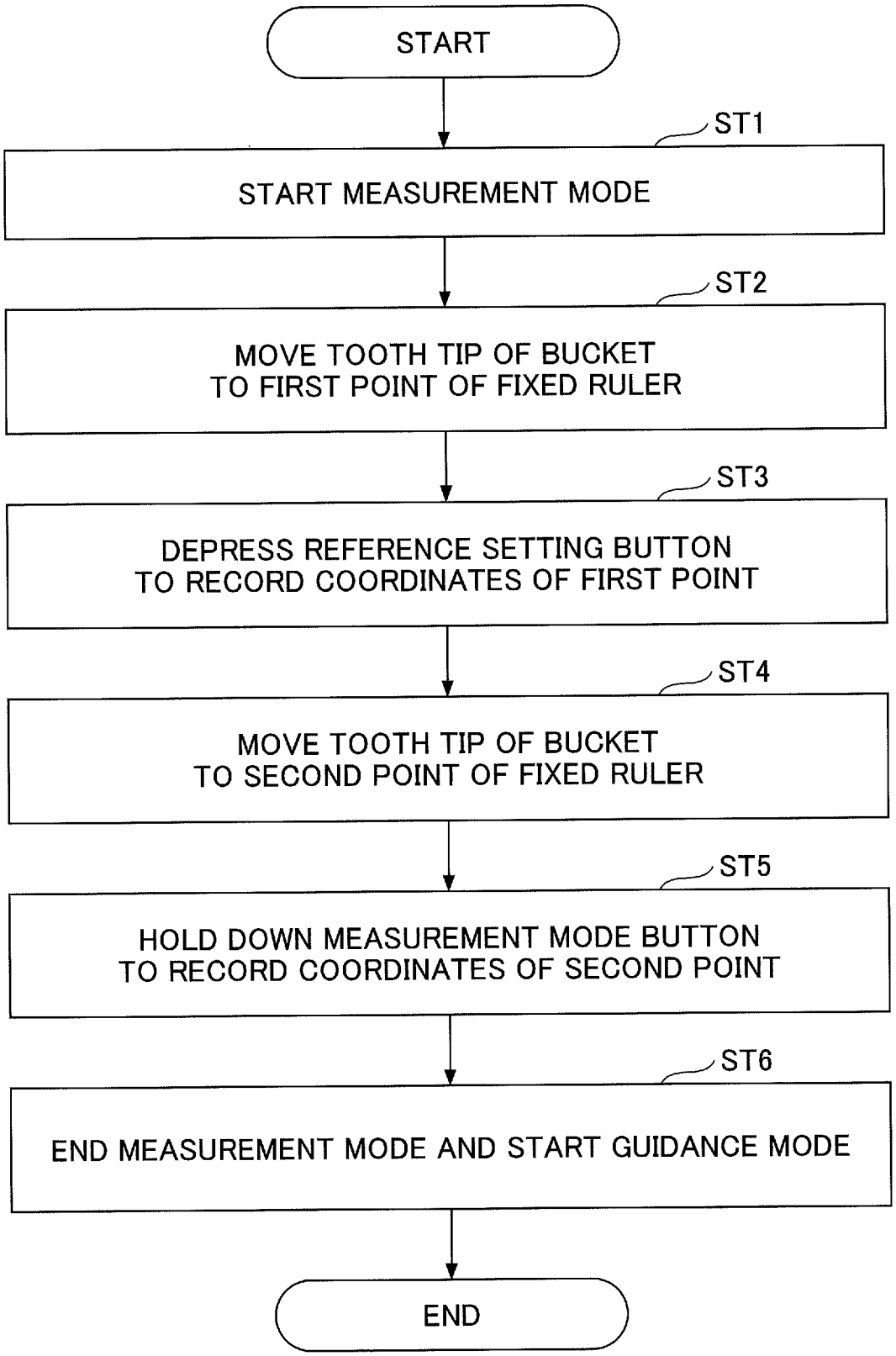
FIG. 5 is a flowchart of an operating procedure that an operator follows to set a target value used in a two-dimensional machine guidance function or a two-dimensional machine control function.
Figure 6:
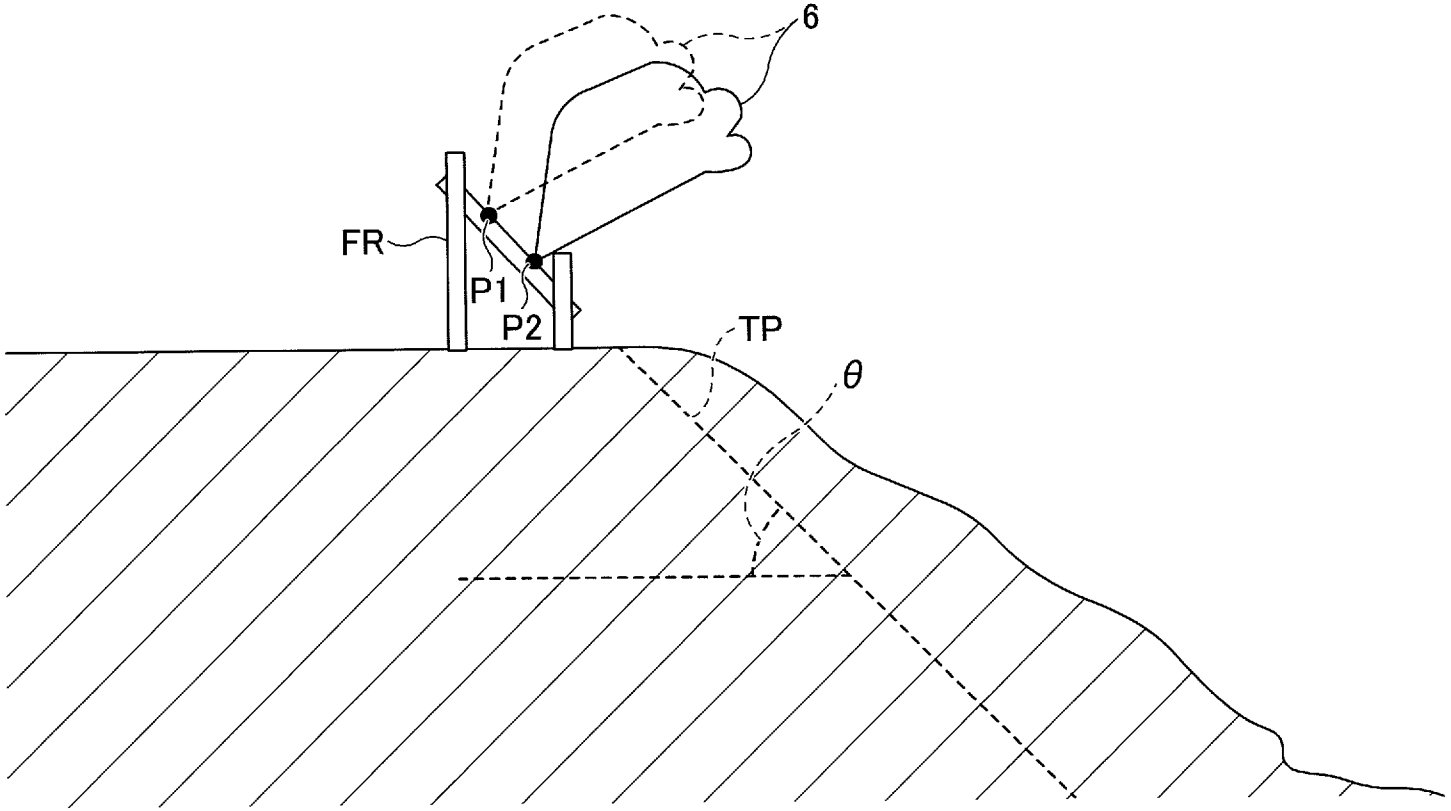
FIG. 6 is a sectional view of an excavation target area on which a fixed ruler is installed.

Next, a method of setting a target value used in a two-dimensional machine guidance function or a two-dimensional machine control function is described with reference to FIGS. 5 and 6. FIG. 5 is a flowchart of an operating procedure that the operator follows to set a target value. The target value is, for example, a target angle (target slope angle). FIG. 6 is a sectional view of an excavation target area on which a fixed ruler FR is installed. In FIG. 6, the bucket 6 indicated by the dashed line illustrates the condition of the bucket 6 at a first point of time, and the bucket 6 indicated by a solid line illustrates the condition of the bucket 6 at a second point of time later than the first point of time.

First, the operator starts the measurement mode (step ST1). For example, the operator depresses the measurement mode button 26S2 of the left operating lever 26L to start the measurement mode.

Thereafter, as illustrated in FIG. 6, the operator moves the tooth tip of the bucket 6 to a first point P1 of the fixed ruler FR (step ST2). For example, the operator operates the left operating lever 26L and the right operating lever 26R to move the excavation attachment to cause the tooth tip of the bucket 6 to contact the first point P1 of the fixed ruler FR. The controller 30 can calculate the position of the tooth tip of the bucket 6 as the coordinates of the first point P1 using the output of the posture sensor.

Thereafter, the operator depresses the reference setting button 26S1 of the left operating lever 26L to record the coordinates of the first point P1 (step ST3). For example, the operator depresses the reference setting button 26S1 while keeping the tooth tip of the bucket 6 in contact with the first point P1 to record the coordinates of the first point P1 as the origin. The operator may alternatively record the coordinates of the first point P1 as the origin by making the excavation attachment stationary for a predetermined period while keeping the tooth tip of the bucket 6 in contact with the first point P1. The coordinates of the first point P1 may alternatively be recorded as, for example, relative coordinates with respect to reference coordinates such as the coordinates of a point on the turning axis of the shovel or the coordinates of a point on a boom foot pin.

Thereafter, the operator moves the tooth tip of the bucket 6 to a second point P2 of the fixed ruler FR (step ST4). For example, the operator operates the left operating lever 26L and the right operating lever 26R to move the excavation attachment to cause the tooth tip of the bucket 6 to contact the second point P2 of the fixed ruler FR. The controller 30 can calculate the position of the tooth tip of the bucket 6 as the coordinates of the second point P2 using the output of the posture sensor.

Thereafter, the operator holds down the measurement mode button 26S2 of the left operating lever 26L to record the coordinates of the second point P2 (step ST5). For example, the operator holds down the measurement mode button 26S2 while keeping the tooth tip of the bucket 6 in contact with the second point P2 to record the coordinates of the second point P2 as relative coordinates with respect to the coordinates of the first point P1. The operator may alternatively record the coordinates of the second point P2 as relative coordinates with respect to the coordinates of the first point P1 by making the excavation attachment stationary for a predetermined period while keeping the tooth tip of the bucket 6 in contact with the second point P2. The coordinates of the second point P2 may alternatively be recorded as, for example, relative coordinates with respect to reference coordinates. Furthermore, while the coordinates of the second point P2 are recorded in distinction from the coordinates of the first point P1 by holding down the measurement mode button 26S2 in the above-described illustration, the coordinates of the second point P2 may be recorded by other than holding down a button. For example, the coordinates of the first point P1 and the coordinates of the second point P2 may be recorded in distinction from each other by changing the number of times the button is pressed. Specifically, the coordinates of the first point P1 may be recorded in response to a single click on the button, and the coordinates of the second point P2 may be recorded in response to a double click on the button. In this case, the same button may be used to record the coordinates of the first point P1 and the coordinates of the second point P2. The coordinates of the second point P2 may be recorded by holding down or double-clicking the reference setting button 26S1. Furthermore, if it is possible to recognize the recording of the coordinates of the first point P1 by audio output or display, the operator may simply record the coordinates of the first point P1 by the first depression of the reference setting button 26S1 and record the coordinates of the second point P2 by the second depression of the reference setting button 26S1. Furthermore, in addition to the reference setting button 26S1 and the measurement mode button 26S2, a third button may be provided. In this case, the operator can depress the measurement mode button 26S2 to start the measurement mode, depress the reference setting button 26S1 to record the coordinates of the first point P1, and depress the third button to record the coordinates of the second point P2.

The machine guidance device 50 sets a target slope angle θ based on the coordinates of the first point P1 and the coordinates of the second point P2. For example, the machine guidance device 50 identifies, among virtual planes directly opposite the shovel, a virtual plane including a virtual straight line passing through the first point P1 and the second point P2 as a virtual plane including a target work surface TP, and calculates the angle formed between the virtual plane and a horizontal plane as the target slope angle θ. In the illustration of FIG. 6, a virtual plane including an extension line of a virtual straight line passing through the first point P1 and the second point P2 is set as the target work surface TP, while the virtual plane including the extension line may be set as a work reference plane. In this case, after setting the work reference plane, the operator can set the target work surface TP by setting distances such as a depth and a width from the work reference plane through a switch panel 42 (see FIG. 4). Thus, the operator can set a target work surface based on the measured first point P1 and second point P2.

Thereafter, the operator ends the measurement mode and starts the guidance mode (step ST6). For example, the operator starts the guidance mode by ending the measurement mode by depressing the measurement mode button 26S2 of the left operating lever 26L.

Thereafter, for example, the operator depresses the reference setting button 26S1 while having the tooth tip of the bucket 6 contacting a reference point at the top of slope. As a result, it is possible to start the two-dimensional machine guidance function for forming a slope of the target slope angle θ with respect to the reference point.

Figure 7:
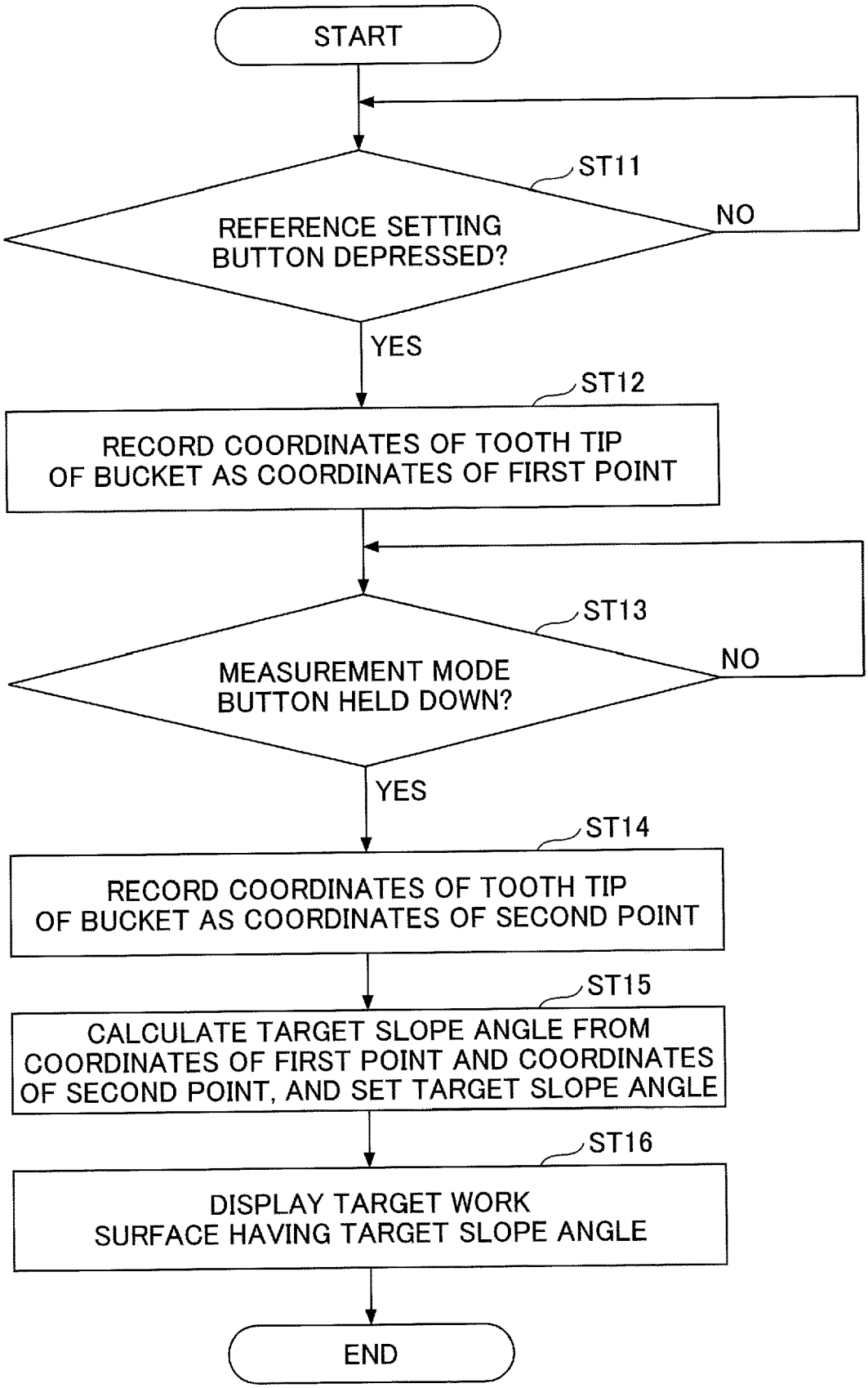
FIG. 7 is a flowchart of a target angle setting process.

Next, an operation of the machine guidance device 50 in the measurement mode is described with reference to FIG. 7. FIG. 7 is a flowchart of a process of setting the target slope angle θ by the machine guidance device 50 in the measurement mode (hereinafter referred to as "target angle setting process"). For example, the machine guidance device 50 executes this target angle setting process in response to depression of the measurement mode button 26S2.

First, the target setting part 504 of the machine guidance device 50 determines whether the reference setting button 26S1 is depressed (step ST11). In response to determining that the reference setting button 26S1 is not depressed (NO at step ST11), the target setting part 504 repeats the determination until the reference setting button 26S1 is depressed.

In response to determining that the reference setting button 26S1 is depressed (YES at step ST11), the target setting part 504 records the coordinates of the tooth tip of the bucket 6 as the coordinates of the first point P1. For example, the target setting part 504 stores the coordinates of the tooth tip of the bucket 6 at the time of the depression of the reference setting button 26S1 in a predetermined area of the storage device D4 as the coordinates of the first point P1. The origin of a coordinate system is, for example, a point on the turning axis of the shovel or a point on a boom foot pin. The origin of a coordinate system may be the first point P1.

Thereafter, the target setting part 504 determines whether the measurement mode button 26S2 is held down (step ST13). In response to determining that the measurement mode button 26S2 is not held down (NO at step ST13), the target setting part 504 repeats the determination until the measurement mode button 26S2 is held down.

In response to determining that the measurement mode button 26S2 is held down (YES at step ST13), the target setting part 504 records the coordinates of the tooth tip of the bucket 6 as the coordinates of the second point P2 (step ST14). For example, the target setting part 504 stores the coordinates of the tooth tip of the bucket 6 at the time of the holding-down of the measurement mode button 26S2 in a predetermined area of the storage device D4 as the coordinates of the second point P2.

Thereafter, the target setting part 504 calculates the target slope angle θ from the coordinates of the first point P1 and the coordinates of the second point P2 and sets the target slope angle θ (step ST15). For example, the target setting part 504 identifies a virtual plane including a virtual straight line passing through the first point P1 and the second point P2 as a virtual plane including the target work surface TP. Then, the target setting part 504 calculates the angle formed between the virtual plane and a horizontal plane, and stores the angle in a predetermined area of the storage device D4 as the target slope angle θ.

Thereafter, the target setting part 504 displays the target work surface TP having the target slope angle θ (step ST16). In the illustration of FIGS. 6 and 7, the measurement mode is used in setting the target work surface TP. The measurement mode, however, may also be used in checking finish after work. By using the measurement mode after work, the operator can determine whether work surface-related values such as the position and the angle of a work surface calculated from the first point P1 and the second point P2 are within target value ranges.

Figure 8:
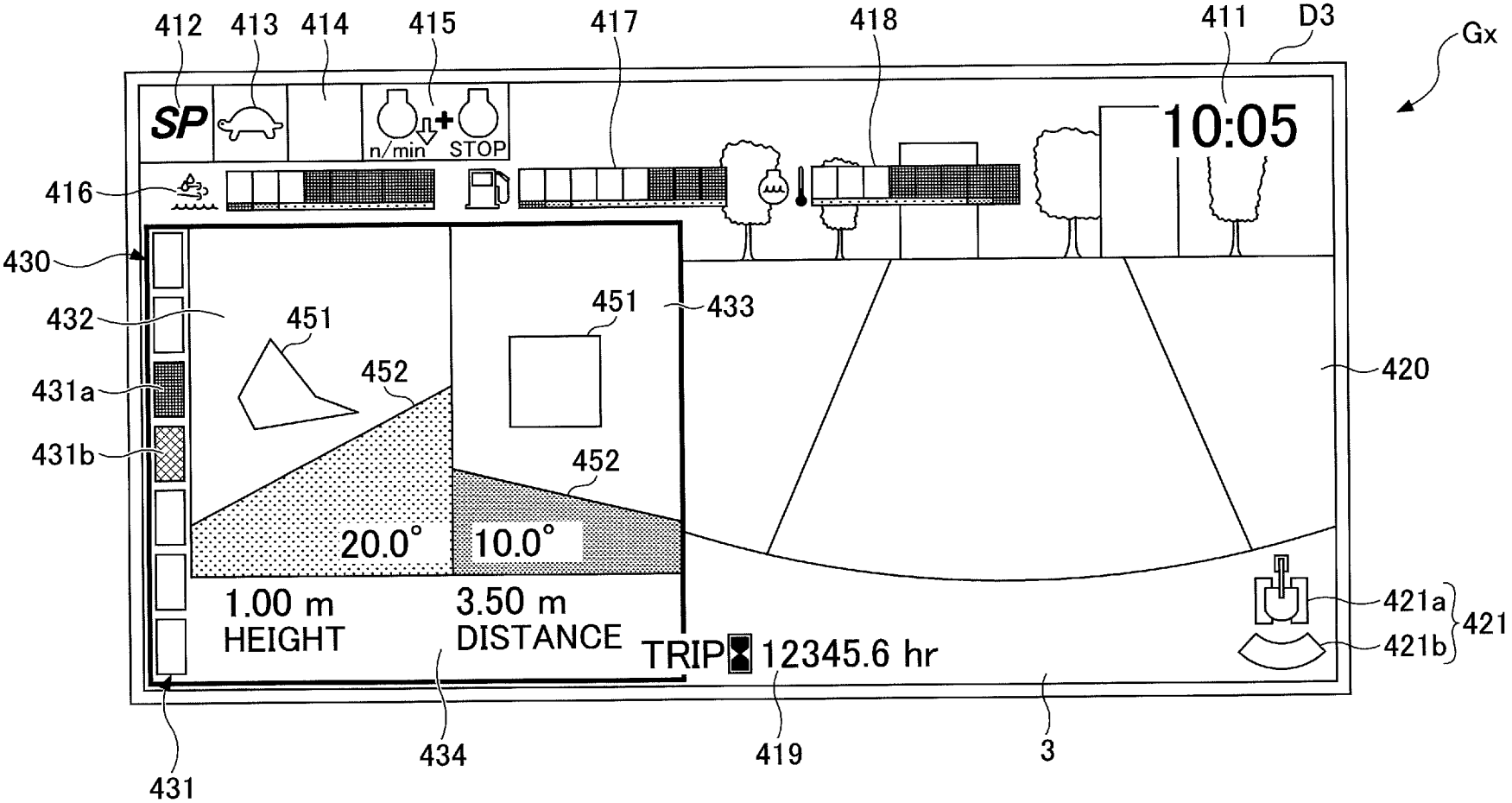
FIG. 8 is a diagram illustrating an output image that is displayed in a guidance mode.

Next, an output image displayed in the guidance mode is described with reference to FIG. 8. FIG. 8 illustrates an example of an output image Gx that is displayed on the display device D3 in the guidance mode. In the illustration of FIG. 8, a reference position and a target work surface are already set.

As illustrated in FIG. 8, the output image Gx displayed on the display device D3 includes a time display part 411, a rotational speed mode display part 412, a traveling mode display part 413, an attachment display part 414, an engine control status display part 415, a remaining aqueous urea solution amount display part 416, a remaining fuel amount display part 417, a coolant water temperature display part 418, an engine operating time display part 419, a camera image display part 420, and a work guidance display part 430. The rotational speed mode display part 412, the traveling mode display part 413, the attachment display part 414, and the engine control status display part 415 are a display part that displays information on the settings of the shovel. The remaining aqueous urea solution amount display part 416, the remaining fuel amount display part 417, the coolant water temperature display part 418, and the engine operating time display part 419 are a display part that displays information on the operating condition of the shovel. Images displayed in the parts are generated by the conversion part D3*a* of the display device D3, using various kinds of data transmitted from the controller 30 or the machine guidance device 50 and an image transmitted from the camera S6.

The time display part 411 displays a current time. In the illustration of FIG. 8, a digital display is employed, and a current time (10:05) is displayed.

The rotational speed mode display part 412 displays a rotational speed mode set by the engine rotational speed adjustment dial 75 as operating information of the shovel. Examples of the rotational speed mode include the above-described four modes, namely, SP mode, H mode, A mode, and idling mode. In the illustration of FIG. 8, a symbol "SP" representing SP mode is displayed.

The traveling mode display part 413 displays a traveling mode as operating information of the shovel. The traveling mode represents the setting of traveling hydraulic motors using a variable displacement motor. For example, the traveling mode includes a low-speed mode and a high-speed mode. A "turtle"-shaped mark is displayed in the low-speed mode, and a "rabbit"-shaped mark is displayed in the high-speed mode. In the illustration of FIG. 8, the "turtle"-shaped mark is displayed to make it possible for the operator to recognize that the low-speed mode is set.

The attachment display part 414 displays an image representing an attachment that is attached as operating information of the shovel. Various attachments such as the bucket 6, a rock drill, a grapple, and a lifting magnet are attachable to the shovel. The attachment display part 414 displays, for example, marks shaped like these end attachments and numbers corresponding to the end attachments. In the illustration of FIG. 8, because the bucket 6, which is standard as an end attachment, is attached, the attachment display part 414 is blank. When a rock drill is attached as an end attachment, for example, a rock drill-shaped mark is displayed in the attachment display part 414, together with a number representing the magnitude of the output of the rock drill.

The engine control status display part 415 displays the control status of the engine 11 as operating information of the shovel. In the illustration of FIG. 8, "automatic deceleration and automatic stop mode" is selected as the control status of the engine 11. The "automatic deceleration and automatic stop mode" means a control status to automatically reduce the engine rotational speed and further to automatically stop the engine 11 in accordance with the duration of a non-operating condition. Other control statuses of the engine 11 include "automatic deceleration mode," "automatic stop mode," "manual deceleration mode," etc.

The remaining aqueous urea solution amount display part 416 displays the status of the remaining amount of an aqueous urea solution stored in an aqueous urea solution tank as operating information of the shovel. In the illustration of FIG. 8, a bar gauge representing a current status of the remaining amount of an aqueous urea solution is displayed. The remaining amount of an aqueous urea solution is displayed based on, for example, the output data of a remaining aqueous urea solution amount sensor provided in the aqueous urea solution tank.

The remaining fuel amount display part 417 displays the status of the remaining amount of fuel stored in a fuel tank as operating information of the shovel. In the illustration of FIG. 8, a bar gauge representing a current status of the remaining amount of fuel is displayed. The remaining amount of fuel is displayed based on, for example, the output data of a remaining fuel amount sensor provided in the fuel tank.

The coolant water temperature display part 418 displays the temperature condition of engine coolant water as operating information of the shovel. In the illustration of FIG. 8, a bar gauge representing the temperature condition of engine coolant water is displayed. The temperature of engine coolant water is displayed based on, for example, the output data of the water temperature sensor 11*c* provided on the engine 11.

The engine operating time display part 419 displays the cumulative operating time of the engine 11 as operating information of the shovel. In the illustration of FIG. 8, a cumulative operating time since the restart of counting by the operator is displayed together with a unit "hr (hour)." A lifelong operating time in the entire period after the manufacture of the shovel or a section operating time since the restart of counting by the operator is displayed in the engine operating time display part 419.

The camera image display part 420 displays an image captured by the camera S6. According to this embodiment, the camera image display part 420 displays an image captured by the camera S6 as a camera image during the operation of the shovel. If an image other than the camera image is displayed at the start of the operation of the shovel, the camera image display part 420 switches the other image to the camera image. For example, the camera image display part 420 determines that the operation is started when the engine 11 is turned ON. Then, if an image other than the camera image is displayed, the camera image display part 420 switches the other image to the camera image. Alternatively, the camera image display part 420 determines that the operation is started when the gate lock lever D5 is pulled up or an operating lever is operated. Then, if an image other than the camera image is displayed, the camera image display part 420 switches the other image to the camera image. In the illustration of FIG. 8, an image captured by a back-side camera attached to the lower end of the upper surface of the upper turning body 3 is displayed in the camera image display part 420. An image captured by a left-side camera attached to the left end of the upper surface of the upper turning body 3 or a right-side camera attached to the right end of the upper surface of the upper turning body 3 may be displayed in the camera image display part 420. Images captured by two or more of the left-side camera, the right-side camera, and the back-side camera may be displayed side by side in the camera image display part 420. A composite image based on multiple images captured by at least two of the left-side camera, the right-side camera, and the back-side camera may be displayed in the camera image display part 420. The composite image may be, for example, an overhead view.

Each camera is installed such that part of the upper turning body 3 is included in the camera image. The operator has a better sense of distance between an object displayed in the camera image display part 420 and the shovel because of inclusion of part of the upper turning body 3 in the displayed image.

In the camera image display part 420, a camera icon 421 representing the orientation of the camera S6 that has captured the camera image that is being displayed is displayed. The camera icon 421 is composed of a shovel icon 421*a* representing the shape of the shovel and a strip-shaped orientation indicator icon 421*b* representing the orientation of the camera S6 that has captured the camera image that is being displayed. The camera icon 421 is a display part that displays information on the settings of the shovel.

In the illustration of FIG. 8, the orientation indicator icon 421*b* is displayed below the shovel icon 421*a* (on the opposite side from an image representing the attachment) to indicate that a rearview image of the shovel captured with the back-side camera is displayed in the camera image display part 420. For example, when an image captured by the right-side camera is displayed in the camera image display part 420, the orientation indicator icon 421*b* is displayed to the right of the shovel icon 421*a*. For example, when an image captured by the left-side camera is displayed in the camera image display part 420, the orientation indicator icon 421*b* is displayed to the left of the shovel icon 421*a*.

For example, the operator can switch an image captured by a camera displayed in the camera image display part 420 to an image captured by another camera or the like by depressing an image change switch provided in the cabin 10.

If the shovel is not provided with the camera S6, information other than the camera image may be displayed instead of the camera image display part 420.

The work guidance display part 430 displays guidance information for various kinds of work. In the illustration of FIG. 8, the work guidance display part 430 includes a position indicator image 431, a first target work surface display image 432, a second target work surface display image 433, and a numerical value information image 434, which display tooth tip guidance information that is an example of working part guidance information. The position indicator image 431 is a bar gauge of vertically arranged segments, and shows the size of a distance from the working part of the attachment (for example, the end of the bucket 6) to a target work surface. Specifically, in accordance with the distance from the end of the bucket 6 to the target work surface, a bucket position indicator segment 431*a*, which is one of the seven segments, is displayed in a color different from those of the other segments. In the illustration of FIG. 8, the third segment from the top is displayed in a color different from those of the other segments as the bucket position indicator segment 431*a*. The position indicator image 431 may be composed of a larger number of segments to make it possible to more accurately display the distance from the end of the bucket 6 to the target work surface.

Thus, the machine guidance device 50 changes the color of a partial area of the display screen of the display device D3 in accordance with the size of the distance. The "partial area of the display screen" is, for example, a relatively small area such as one segment of the work guidance display part 430. Alternatively, the machine guidance device 50 may change the color of the entire area of the display screen in accordance with the size of the distance. The "entire area of the display screen" is, for example, a relatively large area such as the entire area within the frame of the work guidance display part 430. In this case, because the color changes in a large area, the operator can easily see the change of the color in her/his peripheral vision. The "entire area of the display screen" may also be the entire area of the camera image display part 420 or the entire area of the output image Gx.

In the following, the position indicator image 431 is more specifically described. Letting a central segment be a reference segment 431*b* representing the level of the target work surface, as the distance from the end of the bucket 6 to the target work surface becomes larger, a segment more distant from the reference segment 431*b* is displayed in a color different from those of the other segments as the bucket position indicator segment 431*a*. That is, as the distance from the end of the bucket 6 to the target work surface becomes smaller, a segment closer to the reference segment 431*b* is displayed in a color different from those of the other segments as the bucket position indicator segment 431*a*. The bucket position indicator segment 431*a* is so displayed as to vertically move in accordance with a change in the distance from the end of the bucket 6 to the target work surface. The reference segment 431*b* is displayed in a color different from those of the other segments including the bucket position indicator segment 431*a*. By looking at the position indicator image 431, the operator can understand the size of a current distance from the end of the bucket 6 to the target work surface. A segment other than the central segment may be set as the reference segment 431*b*.

The first target work surface display image 432 schematically shows the relationship between the bucket 6 and the target work surface as the tooth tip guidance information. In the first target work surface display image 432, the bucket 6 and the target work surface as viewed from the side are schematically displayed with a bucket icon 451 and a target work surface image 452. The bucket icon 451 is a graphic representing the bucket 6 and is shown in the shape of the bucket 6 as viewed from the side. The target work surface image 452 is a graphic representing a ground surface as the target work surface, and is shown in the shape as viewed from the side the same as the bucket icon 451. The target work surface image 452 is displayed with, for example, the angle formed between a line segment representing the target work surface and a horizontal line in a vertical plane vertically intersecting the bucket 6 (the target slope angle θ; hereinafter referred to as "vertical inclination angle"). In the illustration of FIG. 8, the vertical inclination angle is 20.0°. The interval between the bucket icon 451 and the target work surface image 452 is so displayed as to vary in accordance with a change in the actual distance between the end of the bucket 6 and the target work surface. Likewise, the relative vertical inclination angle between the bucket icon 451 and the target work surface image 452 is so displayed as to vary in accordance with a change in the actual relative vertical inclination angle between the bucket 6 and the target work surface.

The operator can understand the positional relationship between the bucket 6 and the target work surface and the vertical inclination angle of the target work surface by looking at the first target work surface display image 432. In the first target work surface display image 432, the target work surface image 452 may be displayed with a vertical inclination angle that is greater than actually is to improve visibility for the operator. The operator can recognize an approximate size of the vertical inclination angle from the target work surface image 452 displayed in the first target work surface display image 432. When the operator desires to know a precise vertical inclination angle, the operator can know an actual vertical inclination angle by looking at the value of the vertical inclination angle displayed below the target work surface image 452.

The second target work surface display image 433 schematically shows the relationship between the bucket 6 and the target work surface in a forward looking view from the shovel that the operator has when seated in the cabin 10 as the tooth tip guidance information. The bucket icon 451 and the target work surface image 452 are, displayed in the second target work surface display image 433. The bucket icon 451 is shown in the shape of the bucket 6 as viewed from the cabin 10. The target work surface image 452 is shown in the shape as viewed from the cabin 10 the same as the bucket icon 451. The target work surface image 452 is displayed with, for example, the angle formed between a line segment representing the target work surface and a horizontal line in a vertical plane laterally intersecting the bucket 6 (hereinafter referred to as "lateral inclination angle"). In the illustration of FIG. 8, the lateral inclination angle is 10.0°. The interval between the bucket icon 451 and the target work surface image 452 is so displayed as to vary in accordance with a change in the actual distance between the end of the bucket 6 and the target work surface. Likewise, the relative lateral inclination angle between the bucket icon 451 and the target work surface image 452 is so displayed as to vary in accordance with a change in the actual relative lateral inclination angle between the bucket 6 and the target work surface.

The operator can understand the positional relationship between the bucket 6 and the target work surface and the lateral inclination angle of the target work surface by looking at the second target work surface display image 433. In the second target work surface display image 433, the target work surface image 452 may be displayed with a lateral inclination angle that is greater than actually is to improve visibility for the operator. The operator can recognize an approximate size of the lateral inclination angle from the target work surface image 452 displayed in the second target work surface display image 433. When the operator desires to know a precise lateral inclination angle, the operator can know an actual lateral inclination angle by looking at the value of the lateral inclination angle displayed below the target work surface image 452.

The numerical value information image 434 displays various kinds of numerical values as measurement information or the tooth tip guidance information. Various kinds of information indicate, for example, the positional relationship between the end of the bucket 6 and the target work surface. In the illustration of FIG. 8, in the numerical value information image 434, the height of the end of the bucket 6 from the target work surface (the vertical distance between the end of the bucket 6 and the target work surface, which is 1.00 m in the illustration of FIG. 8) is displayed. Furthermore, in the numerical value information image 434, the distance from the turning axis to the end of the bucket 6 (3.50 m in the illustration of FIG. 8) is displayed. Other numerical value information such as the turning angle of the upper turning body 3 relative to a reference direction may also be displayed.

As described above, the output image Gx includes a display part including the operating information of the shovel, a display part including the camera image, and a display part including the tooth tip guidance information. One of the display part including the operating information of the shovel and the display part including the camera image, however, may be omitted. For example, the output image Gx may include only the display part including the camera image and the display part including the tooth tip guidance information or include only the display part including the operating information of the shovel and the display part including the tooth tip guidance information.

Thus, during the operation of the shovel in the guidance mode, the screen illustrated in FIG. 8 is displayed on the display device D3. The operator can perform excavation work while having the bucket 6 in the center of her/his visual field through the windshield FG and seeing the output image Gx displayed on the display device D3 in her/his peripheral vision.

Figure 9:
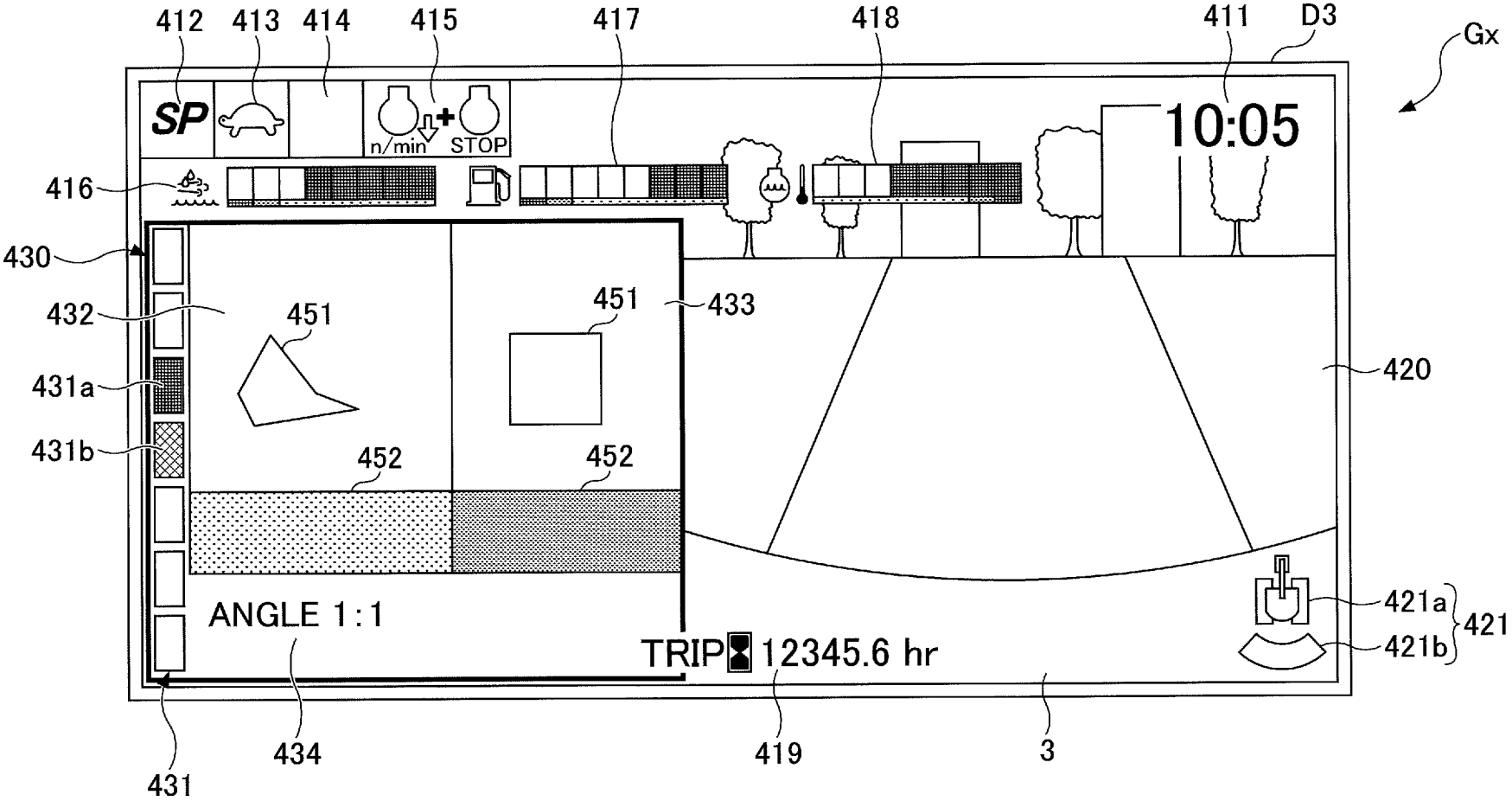
FIG. 9 is a diagram illustrating an output image that is displayed in a measurement mode.

Next, an output image displayed in the measurement mode is described with reference to FIG. 9. FIG. 9 illustrates an example of the output image Gx that is displayed on the display device D3 in the measurement mode. Specifically, FIG. 9 illustrates the state of the output image Gx that is displayed when the operator is moving the excavation attachment after the coordinates of the first point P1 are recorded in the measurement mode. That is, FIG. 9 illustrates the state of the output image Gx that is displayed when the operator is moving the excavation attachment after step ST3 of FIG. 5 or after step ST12 of FIG. 7.

The bucket icon 451 and the target work surface image 452 show the positional relationship between the bucket 6 and a virtual plane including a plane in which the shovel is positioned (hereinafter referred to as "virtual ground plane"). This is because no target slope angle is set (a default value is set). Specifically, this is because the target slope angle is set to 0 degrees. The default value setting may be replaced with another setting.

The output image Gx of FIG. 9 displays the angle of a virtual straight line passing through the first point P1 and a current end position of the bucket 6 relative to a horizontal plane (hereinafter referred to as "provisional angle" as geometric information) as the numerical value information image 434. The output image Gx of FIG. 9 is different from the output image Gx of FIG. 8 in the guidance mode in displaying this provisional angle. In the illustration of FIG. 9, the provisional angle is expressed in the ratio of a unit length in a horizontal direction and a length (height) in a vertical direction as "1:1." The provisional angle, however, may alternatively be expressed in percentage (%) or permillage (‰), or in other unit systems such as degree measure, circular measure, and time notation, and "1:1" of FIG. 9 corresponds to 45 degrees in degree measure. The provisional angle changes in accordance with the motion of the excavation attachment. Therefore, for example, by looking at the provisional angle, the operator can check the target slope angle θ indicated by the fixed ruler FR. Furthermore, by holding down the measurement mode button 26S2 when the provisional angle becomes a desired angle, the operator can accurately set the target slope angle θ.

Before the coordinates of the first point P1 are recorded, the display of the provisional angle may be omitted. After the coordinates of the second point P2 are recorded, the bucket icon 451 and the target work surface image 452 may be so displayed as to show the positional relationship between the bucket 6 and the target work surface. This is because the target slope angle θ is already available. In this case, the coordinates of the first point P1 may be used as the coordinates of a reference position.

In the measurement mode, the numerical value information image 434 constitutes a display part that displays geometric information. Therefore, the numerical value information image 434 is also referred to as a measurement mode screen. Information represented by the numerical value information image 434 switches, for example, from information displayed in the guidance mode (the height of the end of the bucket 6 from the target work surface and the distance from the turning axis to the end of the bucket 6) to geometric information (the provisional angle). The numerical value information image 434 may be displayed simultaneously with at least one of the display part that displays information on the operating condition of the shovel and the display part that displays information on the settings of the shovel. In the illustration of FIG. 9, the display device D3 simultaneously displays the numerical value information image 434, the display part that displays information on the operating condition of the shovel (the remaining aqueous urea solution amount display part 416, the remaining fuel amount display part 417, the coolant water temperature display part 418, and the engine operating time display part 419), and the display part that displays information on the settings of the shovel (the rotational speed mode display part 412, the traveling mode display part 413, the attachment display part 414, the engine control status display part 415, and the camera icon 421).

Figure 10:
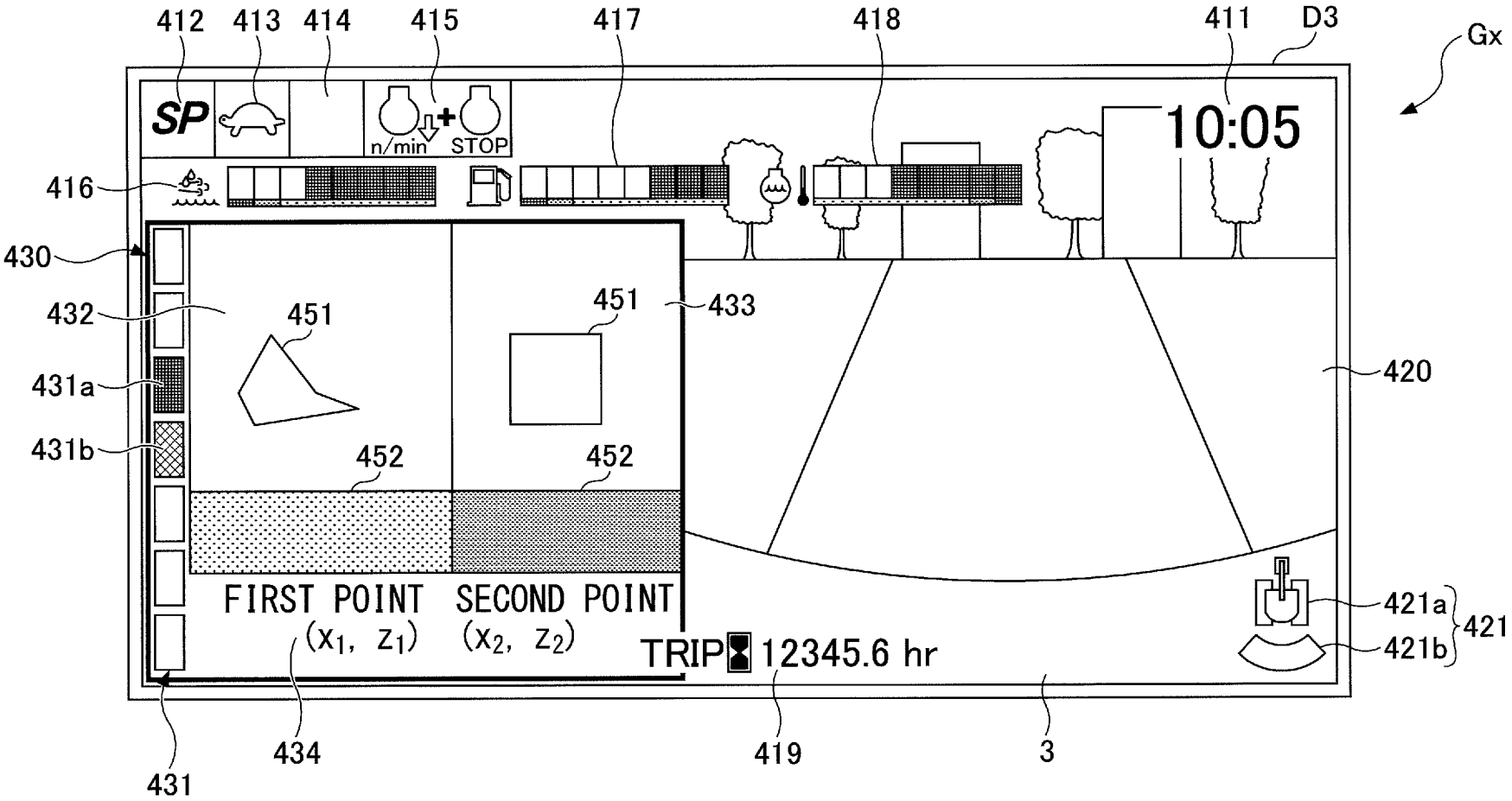
FIG. 10 is a diagram illustrating another output image that is displayed in the measurement mode.

Next, another output image displayed in the measurement mode is described with reference to FIG. 10. FIG. 10 illustrates another example of the output image Gx that is displayed on the display device D3 in the measurement mode. Specifically, the same as FIG. 9, FIG. 10 illustrates the state of the output image Gx that is displayed when the operator is moving the excavation attachment after the coordinates of the first point 21 are recorded in the measurement mode. That is, FIG. 10 illustrates the state of the output image Gx that is displayed when the operator is moving the excavation attachment after step ST3 of FIG. 5 or after step ST12 of FIG. 7.

The output image Gx of FIG. 10 is different from the output image Gx of FIG. 9, which displays the provisional angle as the numerical value information image 434, in displaying the coordinates of the first point P1 and the second point P2 as the numerical value information image 434. Specifically, the output image Gx of FIG. 10 shows "first point ($x_1$, $z_1$)" and "second point ($x_2$, $z_2$)" as the numerical value information image 434. The "first point ($x_1$, $z_1$)" is the coordinates of the first point P1, where "$x_1$"

represents the distance between a reference position and the first point P1 on the x-axis extending in the front-back direction of the shovel and "$z_1$" represents the distance between a reference position and the first point P1 on the z-axis extending in the turning axis direction of the shovel. The reference position is, for example, a point on the virtual ground plane, a point on the turning axis of the shovel, or a point on the boom foot pin. The first point P1 may be the reference position. The same applies to the "second point ($x_2$, $z_2$)."

Furthermore, before the coordinates of the second point P2 are recorded, the output image Gx of FIG. 10 displays the coordinates of a current end position of the bucket 6 (hereinafter referred to as "provisional coordinates" as geometric information) as the coordinates of the second point P2. It may be shown that the coordinates of the second point P2 are provisional coordinates. Alternatively, the coordinates of the second point P2 as the provisional coordinates may be caused to blink to notify the operator that they are provisional coordinates.

Furthermore, before the coordinates of the first point P1 are recorded, the output image Gx of FIG. 10 may display the coordinates of a current end position of the bucket 6 as the coordinates of the first point P1. In this case, it may be shown that the coordinates of the first point P1 are provisional coordinates. The coordinates of the first point P1 as the provisional coordinates may be caused to blink to notify the operator that they are provisional coordinates. In this case, the display of the coordinates of the second point P2 may be omitted, and it may be shown that they are not set.

After the coordinates of the second point P2 are recorded, the bucket icon 451 and the target work surface image 452 may be so displayed as to show the positional relationship between the bucket 6 and the target work surface. This is because the target slope angle θ is already available. In this case, the coordinates of the first point P1 may be used as the coordinates of a reference position.

In place of the coordinates of the first point P1 and the second point P2, the horizontal distance and the vertical distance between the first point P1 and the second point P2 may be displayed as the numerical value information image 434. In this case, before the coordinates of the second point P2 are recorded, the controller 30 calculates the horizontal distance and the vertical distance, using the coordinates of a current end position of the bucket 6 as the coordinates of the second point P2. The output image Gx may show that the horizontal distance and the vertical distance are based on provisional coordinates. The horizontal distance and the vertical distance may be caused to blink to notify the operator that they are based on provisional coordinates. Before the coordinates of the first point P1 are recorded, the display of the horizontal distance and the vertical distance may be omitted.

By the above-described configuration, the shovel according to the embodiment of the present invention makes it possible to set a target value used in the machine guidance function or the machine control function more easily. For example, the machine guidance device 50 installed in the shovel is configured to display geometric information on the display device D3 using information on two end positions of the excavation attachment at two points of time, and to set a target value based on the information on the two end positions. Examples of the geometric information include information on an angle, a horizontal distance, and a vertical distance, and may also include the respective coordinates of the two end positions. Examples of the target value include a target angle such as a target slope angle. Specifically, the machine guidance device 50 displays a provisional angle on the display device D3 using the coordinates of the first point P1 and the second point P2 on the fixed ruler FR, and sets a target slope angle based on the two coordinates. The operator can set the target slope angle by, for example, simply performing twice the work of causing the end of the bucket 6 to contact the fixed ruler FR and pressing a knob switch.

Because of use of the information on the two end positions at two points of time, the machine guidance device 50 can set the target value more accurately. For example, compared with a setting method based on a single angle measurement, such as placing the back surface of the bucket 6 along a reference slope and setting the back surface angle at the time as a target slope angle, it is possible to set the target value more accurately.

Furthermore, the machine guidance device 50 may be configured to set the target value based on the information on the two end positions at two points of time at which the switch 26S serving as a knob switch or a pedal switch is operated. Therefore, the operator can set the target value without releasing her/his hand from an operating lever serving as the operating apparatus 26. Furthermore, the switch 26S may be depressed once when the end position of the bucket 6 reaches a desired position, and there is no need to input or select a numerical value (for example, input a numerical value based on the number of times the button is depressed, select a numerical value based on the length of time for which the button is depressed, or the like) while looking at the screen of the display device D3. Therefore, it is possible to set the target value extremely simply.

Furthermore, the shovel according to the embodiment of the present invention can operate in multiple operating modes including the guidance mode and the measurement modes, and the machine guidance device 50 can set the target value based on the information on the two end positions in the measurement mode and guide or automatically assist the operation of the shovel according to the target value in the guidance mode. The machine guidance device 50 may display different screens in the measurement mode and the guidance mode. Specifically, the machine guidance device 50 may switch the display contents of the numerical value information image 434. Furthermore, the machine guidance device 50 may display various kinds of information at different positions, in different sizes, and in different manners. This is because information to impart to the operator differs in priority. Furthermore, the machine guidance device 50 may display information indicating that the measurement mode is on during the measurement mode in order to enable the operator to recognize that the measurement mode is on. This makes it possible for the operator to set the target value while viewing information suitable for setting the target value.

An embodiment of the present invention is described in detail above. The present invention, however, is not limited to the above-described embodiment, and variations and replacements may be applied to the above-described embodiment without departing from the scope of the present invention.

For example, while the machine guidance device 50 is configured as a control device separate from the controller 30 according to the above-described embodiment, but the present invention is not limited to this configuration. For example, the machine guidance device 50 may be integrated into the controller 30.

What is claimed is:

1. A shovel having a machine guidance function or a machine control function, the shovel comprising:

a lower traveling body;

an upper turning body turnably mounted on the lower traveling body;

a cab mounted on the upper turning body;

an attachment attached to the upper turning body;

a display device provided in the cab; and a hardware processor configured to guide or automatically assist an operation of the shovel according to a target value that is preset with respect to a target work surface, wherein the hardware processor is configured to display geometric information on the display device using information on two end positions of the attachment at two points of time, and to set the target value with respect to the target work surface based on the information on the two end positions.

2. The shovel as claimed in claim 1, wherein the geometric information is information on an angle, and the target value is a target angle.

3. The shovel as claimed in claim 1, wherein the geometric information is a horizontal distance and a vertical distance, and the target value is a target angle.

4. The shovel as claimed in claim 1, further comprising:

an operating lever provided in the cab; and a switch provided on the operating lever, wherein the hardware processor is configured to set the target value based on the information on the two end positions at the two points of time at which the switch is operated.

5. The shovel as claimed in claim 1, further comprising:

a pedal switch provided in the cab, wherein the hardware processor is configured to set the target value based on the information on the two end positions at the two points of time at which the pedal switch is operated.

6. The shovel as claimed in claim 1, wherein the shovel is operable in a plurality of operating modes including a guidance mode and a measurement mode, and the hardware processor is configured to set the target value based on the information on the two end positions in the measurement mode, and to guide or automatically assist the operation of the shovel according to the target value in the guidance mode.

7. The shovel as claimed in claim 6, wherein the display device is configured to display a screen in the measurement mode, the screen being different from a screen displayed in the guidance mode.

8. The shovel as claimed in claim 1, wherein the display device is configured to simultaneously display a display part displaying the geometric information and a display part displaying information on a setting of the shovel.

9. A shovel having a machine guidance function or a machine control function, the shovel comprising:

a lower traveling body;

an upper turning body turnably mounted on the lower traveling body;

a cab mounted on the upper turning body;

an attachment attached to the upper turning body;

a display device provided in the cab; and a hardware processor configured to display geometric information on the display device using information on a first position of an end of the attachment at a first point of time and a second position of the end of the attachment at a second point of time different from the first point of time, set a target value based on the information on the first position and the second position of the end of the attachment, and guide or automatically assist an operation of the shovel according to the set target value.

10. The shovel as claimed in claim 9, wherein the hardware processor is configured to set the target value with respect to a target work surface.

11. The shovel as claimed in claim 9, wherein the hardware processor is configured to calculate and record coordinates of the first position and the second position as the information, and to calculate the target value from the recorded coordinates of the first position and the second position.

* * * * *